United States Patent [19]

Karasawa

[11] Patent Number: 4,752,272

[45] Date of Patent: Jun. 21, 1988

[54] DRIVE MECHANISM FOR TOY

[75] Inventor: Hideyasu Karasawa, Tokyo, Japan

[73] Assignee: Tomy Kogyo Co. Inc., Tokyo, Japan

[21] Appl. No.: 867,324

[22] Filed: May 23, 1986

Related U.S. Application Data

[63] Continuation of Ser. No. 694,143, Jan. 22, 1985, abandoned.

[30] Foreign Application Priority Data

Mar. 15, 1984 [JP] Japan ..... 59-37358[U]

[51] Int. Cl.[4] ..... A63H 11/10

[52] U.S. Cl. ..... 446/289; 446/354

[58] Field of Search ..... 446/289, 436, 437, 441, 446/460, 462, 468, 354

[56] References Cited

U.S. PATENT DOCUMENTS

| | | | |
|---|---|---|---|
| 2,124,302 | 7/1938 | Lohr et al. | 446/436 |
| 2,168,788 | 8/1939 | Biller | 446/436 |
| 2,606,402 | 8/1952 | Fuchs | 446/441 |
| 2,775,848 | 1/1957 | Isaacson | 446/436 |
| 2,784,527 | 3/1957 | Sarff | 446/460 |
| 3,050,900 | 8/1962 | Glass | 446/460 |
| 3,600,851 | 8/1971 | Nielsen | 446/436 |
| 4,135,328 | 1/1979 | Yamasaki | 446/463 |
| 4,272,918 | 6/1981 | Inoue | 446/289 |
| 4,545,451 | 10/1985 | Pipa et al. | 446/463 |
| 4,556,397 | 12/1985 | Arad et al. | 446/437 |
| 4,580,994 | 4/1986 | Fauser et al. | 446/437 |

*Primary Examiner*—Robert A. Hafer
*Assistant Examiner*—Samuel Rimell
*Attorney, Agent, or Firm*—Herb Boswell

[57] ABSTRACT

A drive mechanism for a movable toy has a housing and a motor. A control gear which is movable both rotationally and axially is located on the housing and is connected to the motor through a gear train. Rotation of the control gear is transferred to a control element to rotate it. The control element in turn moves the control gear axially to engage or disengage it with an output member. The output member comprises a drive wheel which is mounted in a yoke which is pivotally mounted on the housing. Rotation of the drive wheel moves the toy along a supporting surface. Additionally, the control element is connected to a further output member and intermittently moves the further output member. Movement of the output member and the further output member are coordinated through the control element whereby when the control element engages the control gear, the drive wheel is moved and when the control element disengages from the control gear, the further output member is moved.

8 Claims, 4 Drawing Sheets

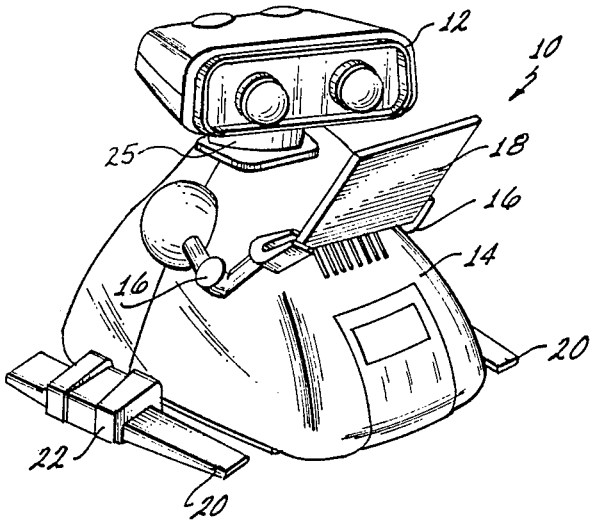
FIG. 1
FIG. 2
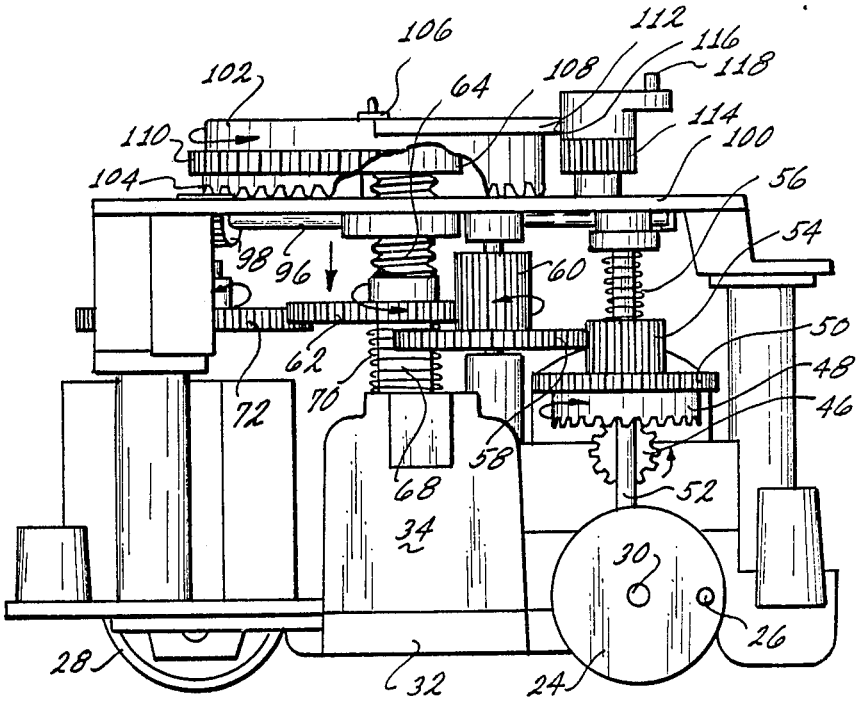

DRIVE MECHANISM FOR TOY

This is a continuation of application Ser. No. 694,143 filed Jan. 22, 1985, now abandoned.

BACKGROUND OF INVENTION

This invention is directed to a drive mechanism for a toy capable of executing a first movement, stopping and then executing a second movement. The drive mechanism includes a motor which drives a gear train with a control gear located in the gear train. The control gear is capable of both rotational and axial movement. A control member interacts with a control gear to move it axially between an engaged and a disengaged position for execution of a movement.

A number of toy vehicles such as cars or motorcycles are known which include a mechanism for changing the steering course of the vehicle in the event that the vehicle contacts an immovable object such as a wall or the like. Two general types of mechanisms are utilized. The first of these is an auxiliary wheel centrally located on the vehicle at an angle to the direction of travel of the vehicle. The second includes a pivoting wheel or set of wheels. Generally, the pivoting wheel or set of wheels would comprise the front wheel or wheels of the vehicle.

The above referred to vehicles, however, all produce a constant output. That is, they are continually driven in the forward direction irrespective of whether or not their "steering wheel" changes this direction. Stated in other terms, they do not produce intermittent motion.

Another class of toys are known which generally have an outside housing either formed as a figurine or as a robot. These are capable of doing tumbling motions or the like upon contact of a solid surface such as a wall. However, these toys only execute the tumbling motion if they contact a wall.

BRIEF DESCRIPTION OF THE INVENTION

In view of the above, it is a broad object of this invention to provide a drive mechanism for a toy which is capable of producing an intermittent motion so as to be entertaining to the user of the toy. It is a further object of this invention to provide a drive mechanism for a toy which is capable of doing one of several different types of motions. It is the further object of this invention to provide a drive mechanism for a toy which, because of the engineering principles incorporated therein, is capable of executing the above intermittent motion, yet is simple and durable in construction so as to provide a drive mechanism for a toy capable of a long and useful lifetime.

These and other objects, as will be come evident from the remainder of this Specification, are achieved in a drive mechanism for a toy which comprises: a housing; a motor means located on said housing, said motor means for producing a rotational output; a gear train means located on said housing in operative association with said motor means so as to be driven by said motor means, said gear train means including a control gear, said control gear mountedon said housing so as to be both rotatably and axially movable on said housing, said control gear rotated by said gear train means in response to rotation of said motor means; a control means rotatably mounted on said housing in operative association with gear train, said control means rotated on said housing by said gear train means, said control means operatively associated with said control gear so as to move said control gear axially between first and second positions in response to rotation of said control means on said housing; a first output means movably mounted on said housing in association with said control gear, said first output means for producing a first intermittent output, said control gear engaging said first output means when said control gear is in its second postion and when so engaged said control gear moving said first output means with respect to said housing, said control gear disengaged from said first output means when said control gear is in its first position.

Further, these objects are achieved by including a rotatably mounted control element as a part of the control means. The control element includes a variety of surfaces thereon which are capable of engaging with other members so as to transmit outputs to these other members. In the illustrative embodiment, these surfaces include cam and gear surfaces located on the control element.

Further in the illustrative embodiment, the control gear is positioned in the gear train so as to be interspaced between the motor means and the control element. When so located, rotation of the control gear is transferred to the control element so as to rotate the control element and, in turn, rotation of the control element axially moves the control gear via a cam on the control element.

BRIEF DESCRIPTION OF THE DRAWINGS

This invention will be better understood when taken in conjunction with the drawings wherein:

FIG. 1 is an isometric view of a toy robot which can utilize the drive mechanism of the invention;

FIG. 2 is a side elevational view partially broken away of the drive mechanism of the invention with the front of the mechanism oriented towards the left;

This invention utilizes certain principles and/or concepts as are set forth in the claims appended hereto. Those skilled in the toy arts will realize that these principles and/or concepts are capable of being utilized in a variety of embodiments which may differ from the exact embodiment utilized for illustrative purposes herein. For this reason this invention is not to be construed as being limited solely to the illustrative embodiment but is only to be construed in view of the claims.

DETAILED DESCRIPTION OF THE INVENTION

The drive mechanism of this invention can be utilized to power certain toys, as for instance the toy robot of FIG. 1.

The toy robot 10 as shown in FIG. 1 is capable of producing several types of output. The first of these is movement along the support surface. The toy robot 10 moves forward until it contacts an abutment such as a wall or the like, at which time it then changes direction and scurries off in a new direction. The above described motion, however, is intermediate motion. The toy robot 10 moves forward either on an original course, or on a new course after contacting an abutment for an increment of time. After this increment of time has expired, the toy robot 10 stops. It now produces an audio output and the head 12 of the robot 10 oscillates back and forth with respect to the body 14 of the robot. After executing this motion for an increment of time, the toy robot 10 then reverts back to its original mode of operation where it moves forward or changes direction upon contact of an abutment.

Figure 3:
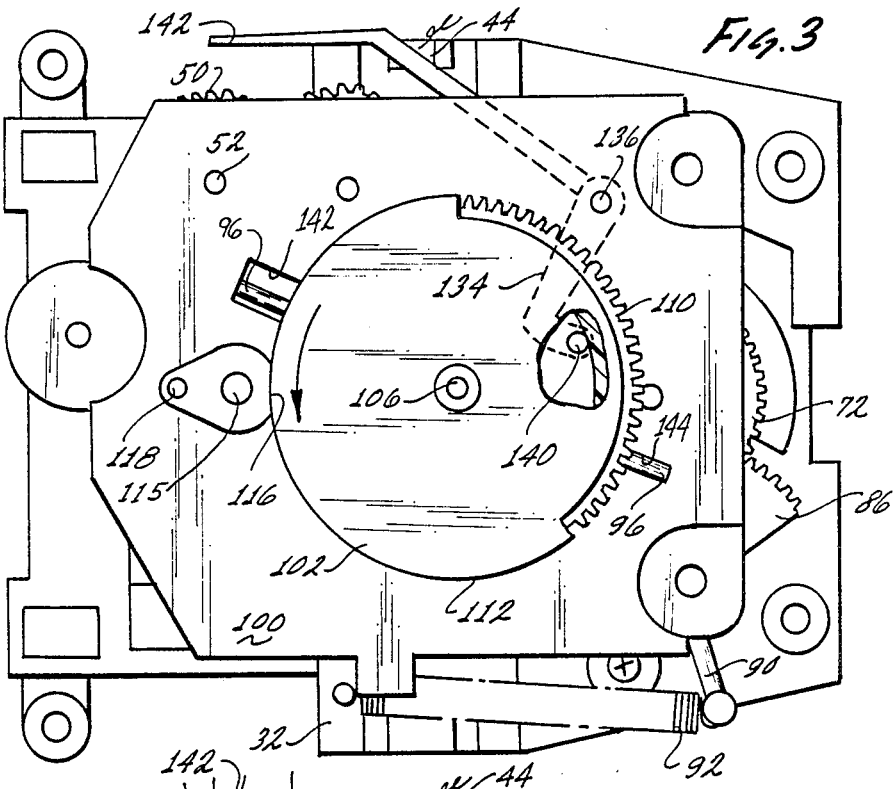
FIG. 3 is a top plan view in partial section of the components of FIG. 2 except the front of the drive mechanism is oriented towards the right.
Figure 4:
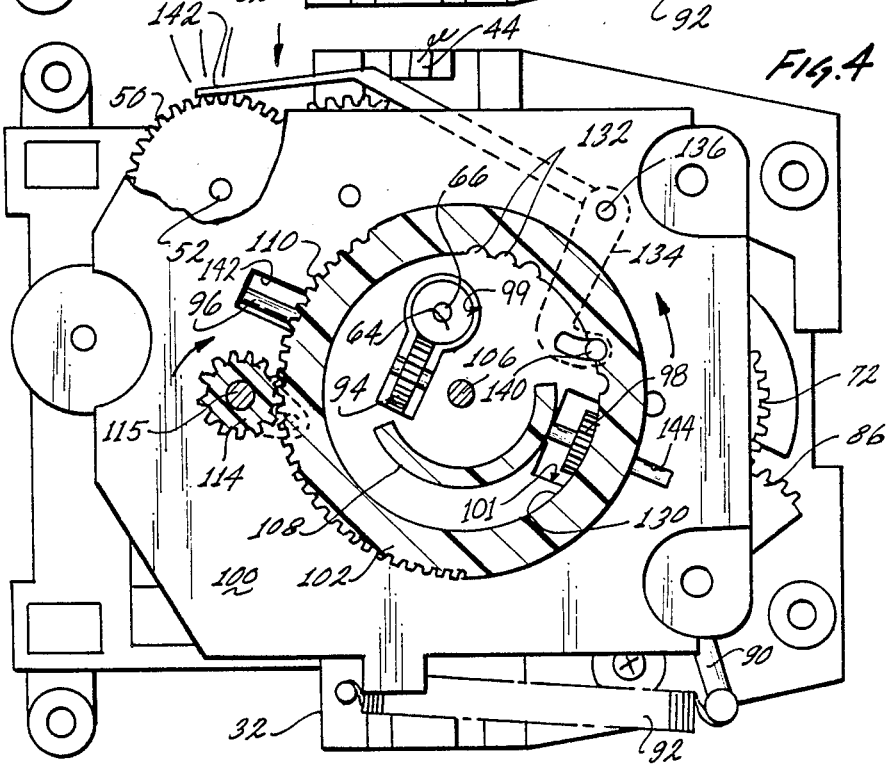
FIG. 4 is a top plan view similar to FIG. 3 except that certain overlaying components are shown in section and others are broken away.
Figure 5:
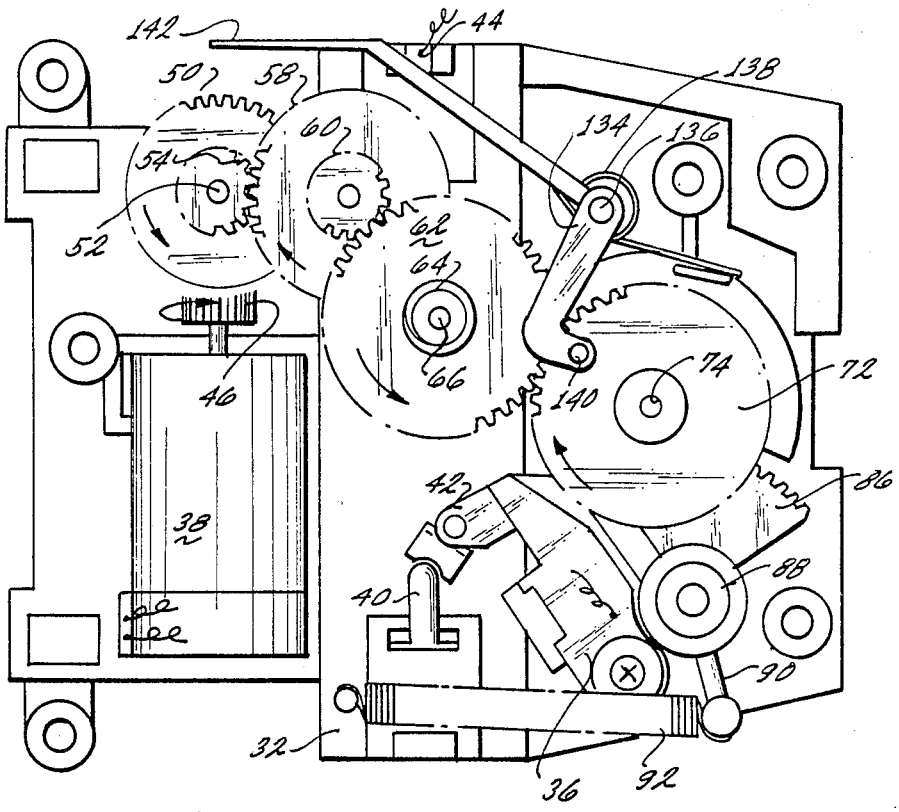
FIG. 5 is a top plan view similar to FIG. 3 except that overlying components seen in FIG. 3 have been removed for clarity of underlying components.
Figures 6, 7:
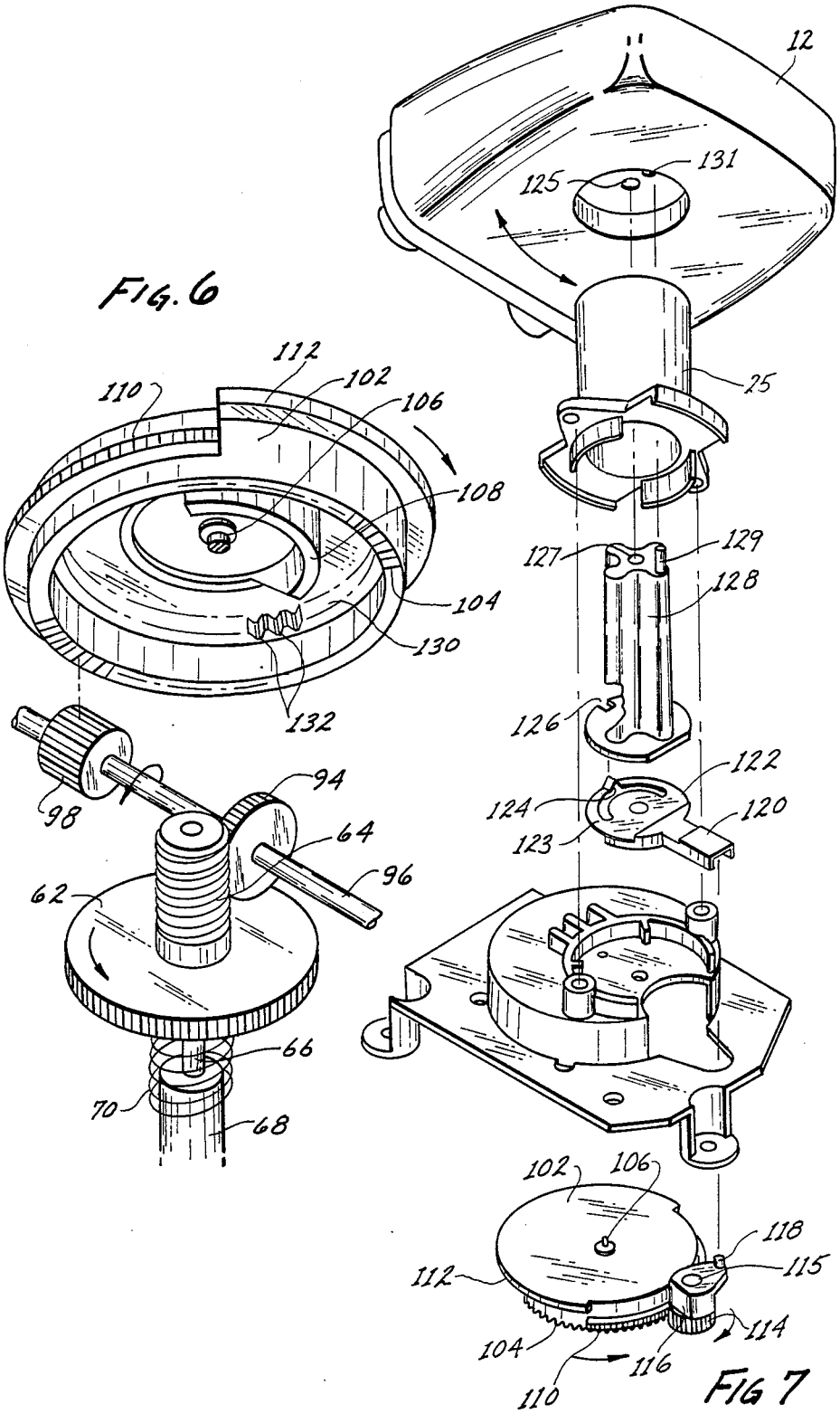
FIG. 6 is an exploded isometric view of certain components positioned in the top portion of FIG. 2.
FIG. 7 is an exploded isometric view showing one of the components of FIG. 6 and further showing certain interior components of the toy robot of FIG. 1.

In viewing the respective figure showing the drive mechanism of the invention in FIGS. 2 and 7, the front of the drive mechanism of the invention woould be oriented toward the left, whereas in FIGS. 3, 4, and 5, it is oriented toward the right.

Attached to the body 14 are two arm members collectively identified by the numeral 16 which can be utilized to hold small objects such as the tablet 18 as seen in FIG. 1. Located on the right and left sides of the body 14 are leg members collectively identified by the numeral 20. The leg members 20 slide backward and forward through outboard members 22, one of which is shown in FIG. 1, which are located on the respective right and left hand sides of the bottom portion of the body 14. The leg members 20 are further connected to the rear wheels, only one of which, wheel 24, is shown in FIG. 2. The connection between the leg member 20 and the rear wheel 24 is via a crank pin 26 which interacts with a slot (not shown) on the leg member 20 such that the leg member 20 moves backward and forward as the wheel 24 is rotated. Located between the head 12 and the body 14 on the toy robot 10 is a neck member 25.

The toy robot 10 is supported via the one rear wheel 24, which is shown, an identical rear wheel which would be located behind it on the other side of a housing 32 as seen in FIG. 2 and a front wheel 28 also mounted on the housing 32. The rear wheel 24, and its twin on the other side of the toy, are mounted so as to freely rotate about an axle, axle 30 for the wheel 24, which projects out of the side of the internal housing 32. The body 14 fits around the internal housing 32, with the housing 32 then supporting the body 14, the neck member 25 and the head 12.

The front wheel 28 serves as a drive wheel which will be hereinafter described. The rear wheels 24 are free to rotate in either direction depending upon the movement of the toy robot 10 as determined by the front wheel 28.

In reference to FIGS. 2 and 5, the internal housing 32 includes a battery storage compartment 34 in which is located an appropriate dry cell. This supplies the power through switch member 36 to a small projection not separately shown or numbered in the figures which extends out of the bottom of the toy 10 such that the switch member 36 can be moved clockwise and counterclockwise as seen in FIG. 5 so as to make a contact with contact element 40 which connects to the battery located in the battery storage compartment 34. A further contact element 42 located on the switch member 36 is wired to the motor 38 and the circuit is completed from the motor 38 to an additional contact element 44 which connects to the other pole of the battery located within the battery compartment 34.

An output pinion 46 is located on the motor shaft of the motor 38 and is rotated by the motor 38. The pinion 46 drives a crown gear 48 which is integrally formed with a spur gear 50. Both of these are carried on shaft 52. Also located on shaft 52 is a pinion 54. A spring 56 biases the pinion 54 against the sput gear 50 to frictionally engage pinion 54 against spur gear 50. This frictional engagement transmits rotation of the crown gear 48 to the pinion 54.

A further gear which includes spur gear 58 integrally formed with pinion gear 60 is located such that the spur gear 58 meshes with the pinion 54. The spur gear 58 and pinion 60 are carried on an axle not separately identified or numbered, which is appropriately journalled within internal housing 32. The pinion 60 is elongated such that a spur gear 62, formed as a portion of a control gear, can move axially along pinon 60, yet always be engaged with it. The spur gear 62 is integrally formed with worm gear 64 and both of these are carried on axle 66, best seen in FIG. 6, which is appropriately journalled in boss 68 such that it can move upwardly or downwardly. A compression spring 70, seen in both FIGS. 2 and 6, biases the spur gear 62 and the worm gear 64 attached thereto upwardly away from the boss 68.

Figure 8:
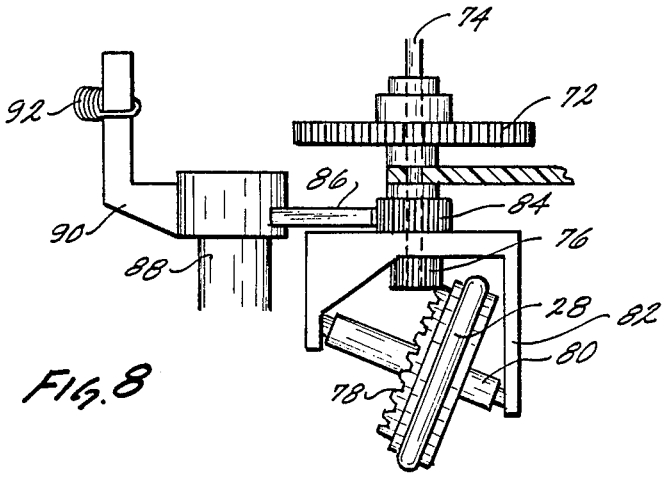
FIG. 8 is a fragmentary front elevational view of certain of the components located near the lower left hand corner of FIG. 2, as well as additional components partially viewable in FIGS. 3, 4, and 5.

If spur gear 62 is positioned downwardly, as is shown in FIG. 2, it meshes with a further spur gear 72 which, as hereinafter explained, is utilized to drive or rotate the front wheel 28. In FIG. 5 the interaction of the spur gear 62 with the spur gear 72 is shown. The spur gear 72 is fixed to an axle 74 which is journalled in the internal housing 32. As can be seen in FIG. 8, fixedly attached to the lower end of axle 74 is a pinion 76. Since both the pinion 76 and the spur gear 72 are fixed to the axle 74, the pinon 76 is rotated in response to rotation of the spur gear 72. The pinion 76 meshes with a crown gear 78 which is fixed to the front wheel 28. The front wheel 28 and the crown gear 78 attached thereto are attached to an axle 80 which is journalled within a yoke 82 at about a 30 degree angle to the horizontal.

The yoke 82 is attached to the bottom of a pinion 84 which is also located on the axle 74. The pinion 84, however, is free to rotate independent of rotation of the axle 74. A gear sector 86, seen in top plan view in FIG. 5, meshes with the pinion 84. The gear sector 86 is rotatably mounted to a boss 88 such that it can rotate about the boss 88. The gear sector 86 includes a small extension 90 which is connected to one end of a spring 92. The other end of the spring 92 is attached to the internal housing 32. The spring 92 biases the gear sector 86 clockwise as seen in FIG. 5.

When the spur gear 62 is located so it meshes with the spur gear 72, rotation transmitted by the axle 74 to the pinion 76 rotates the wheel 28 via the crown gear 78. If, for any reason, the toy robot 10 is inhibited from moving in a forward direction, the crown gear 78 tends to ride around the pinion 76 turning the yoke 82 and the wheel 28 attached is rotating, it rotates the pinion 84 which rotates the gear sector 86, ultimately stretching or biasing the spring 92. As soon as the abutment which was holding the robot 10 from forward movement is no longer impeding the toy robot 10, the bias induced into the spring 92 rotates the gear sector 86 which in turn rotates the yoke 82. This serves to position the front wheel 28 back in a straight line with respect to the fore aft axis of the toy 10 such that the toy robot 10 can once again move in a straight fore aft direction.

Referring now to FIG. 6, the worm gear 64, which together with the spur gear 62 forms a control gear, meshes with a pinion 94 fixedly mounted to an axle 96. On the other end of axle 96 is a pinion 98. The worm gear 64 extends upwardly through an opening 99 (see in FIG. 4) in top plate 100 which forms a portion of the internal housing 32 and an appropriate opening 101 is also formed in the top plate 100 for exposure of the pinion 98. The pinion 94 is also exposed through the opening 99. As is seen in FIG. 2, the axle 96 is appropriately journalled to the underside of the top plate 100, and as seen in FIGS. 3 and 4 portions of the axle 96 are exposed through openings 142 and 144 which are formed in the top plate 100. Journalled to the top plate 100 directly over the axle 96, is a control element 102. The control element 102 has a plurality of gear and cam surfaces located thereon. The first gear surface is formed from a set of crown teeth 104 which are positioned to mesh with pinion 98. As previously explained, the gear train leading from the motor 38 ultimately rotates the control gear composed of spur gear 62 and worm gear 64. Rotation of the worm gear 64 is transferred via pinion 94 through the axle 96 to pinion 98 which, in meshing with crown teeth 104, causes the control element 102 to rotate about its central axle 106 to which it is journalled to the top plate 100.

Located inside on the underneath surface of the control element 102 is a first cam surface 108. The cam surface 108 serves as a first engagement surface for the control element 102. It is positioned so as to contact the top of the worm gear 64 and depress the worm gear 64 and the spur gear 62, attached thereto, such that the spur gear 62 makes contact with and rotates the spur gear 72. When the cam surface 108 clears the top of the worm gear 64, the worm gear 64 and the spur gear 62 attached thereto are biased upwardly by the spring 70 such that the spur gear 62 no longer engages the spur gear 72 and rotation is, therefore, no longer transmitted to the front wheel 28. The cam 108 extends around approximately 135° of the underside surface of the control element 102 and, as such, for every complete rotation of the control element 102, the toy 10 is driven either forward or off to the side by the front wheel 28 for a portion of that rotation.

Extending around a portion of the outside surface of the control element 102 is an additional control surface, gear sector teeth 110. This second set of gear teeth, gear sector 110, also extends around approximately 45° of the circumference of the control element 102. Around the remainder of the outside surface of the control element 102 is a flange 112.

Positioned adjacent to the control element 102 is a gear 114. The gear 114 is positioed such that in response to rotation of the control element 102 during a portion of each complete rotation, the gear sector 110 contacts the gear 114 and rotates it about its center support axle, axle 115. The gear 114 further includes a flat surface 116 which is positioned upwardly from its gear teeth in a position to be contacted by the flange 112 when the flange 112 is positioned adjacent to the gear 114. Thus during the remaining part of each rotation of the control element 102, the flange 112 serves to fix the gear 114 in a locked position whereby the gear 114 does not rotate. Thus, alternately, during each complete rotation of the control element 102, the gear is rotated by the gear sector 110 during a portion of the rotation of the element 102 and then held fixed by the flange 112 during the remainder of each complete rotation of the control element 102.

The gear 114 further includes a crank pin 118 on its upper surface which serves as a further output for the drive mechanism of the invention. For the toy robot of FIG. 1 this further output of the drive mechanism can be utilized to move the head 12 of the robot 10 by coupling the crank pin 118 with further components as are seen in FIG. 7 wherein the crank pin 118 engages with an arm 120 of a crank following member 122. The crank following member 122 includes a small, flat, somewhat rounded shape spring element 123 having a dimple 124 near its edge. As seen in FIG. 7, the spring 123 is attached to the top of the member 122 and, as such, rotates in conjunction with the member 122. the dimple 124 projects upwardly such that it engages in a slot 126 on a head support member 128. the head support member 128 is positioned in and extends through the neck member 25. Location of the head support member 128 in the neck member 25 and the engagement of the dimple 124 in the slot 126 of the head support member 128 locates the head support member 128 over the crank following member 122 and engages the head support member 128 with the crank following member 122. This indirectly engages the head support member 128 with the crank pin 118 which engages the crank following member 122. the head 12 now in turn is attached to the top of the head support member 128 via a small screw (not separately shown or numbered) which passes down through a hole 125 in the head 12 and screws into a hole 127 in the head support member 128. Further, a pin 129 on the head support member 128 fits into a hole 130 on the underside of the head 12 to couple the head 12 to the head support member 128. Now, in response to rotation of the gear 114 during a portion of each rotation of the control element 102, the crank following member 112 is oscillated back and forth. This motion is transferred via the interaction of the dimple 124 in the slot 126 to oscillate the head support member 128 back and forth and the head 12 attached thereto. The head 12 is therefore oscillated back and forth to the right and left in response to rotation of the gear 114 during a portion of each rotation of the control element 102 and is remained fixed during the remaining portion of each rotation of the control element 102.

The gear sector 110 is located on the control element 102 in a position whereby when the cam 108 is in contact with the worm gear 64, depressing it so as to engage spur gear 62 with spur gear 72 to rotate the front wheel, the flat spot 116 of the gear 114 is fixed by the flange 112 on the control element 102 and, thus, as the toy is moved forward by rotation of the front wheel, the head remains stationary. However, when the gear 114 is rotated by the gear sector 110, the cam 108 is not positioned over the worm gear 64, whereas the worm gear 64 and the spur gear 62, attached thereto, are allowed to be pushed upwardly by the spring 70 disengaging the spur gear 62 from the spur gear 72 thus, stopping rotation of the front wheel. However, concurrently, the gear 114 is now rotated and the head oscillates. Thus, when the toy robot 10 is moving forward, its head 12 is fixed, and when it is stationary the head 12 oscillates. The flat spot 116 on the gear 114 is positioned with respect to the crank pin 118 such that when the flange 112 is against the flat spot 116, the head is located in a fore aft direction.

A further control surface on the control element 102 comprises a further cam 130 located in the underneath surface of the control element 102 radially displaced outwardly from the cam 108. The cam 130 includes a plurality of indents in it, collectively identified by the numeral 132. An output member 134, shaped somewhat like a bell crank, is pivoted via an axle 136 to the internal housing 32. A small hairpin spring 138 biases the output member 134 counterclockwise as seen in FIG. 5. Projecting upwardly on one of the arms of the output member 134, is a small peg 140. Peg 140 extends upwardly through the top plate 100 of the internal housing 32 such that it is positioned against the cam 130. In FIG. 4, the peg 140 is located within one of the indents 132 on the cam 130. When the peg 140 is located within one of the indents, the other end of the output member 134, end 142, comes in contact with the spur gear 50. As seen in FIGS. 4 and 5, the spur gear 50 would rotate counterclockwise, and when the end 142 contacts the spur gear 50, a high pitched squeel, much like the sound of a dentist's drill, is emitted from the mechanism of the invention.

If the control element 102 is rotated such that the peg 140 is no longer in one of the indents 132, the presence of the cam 130 causes clockwise rotation of the output member 134 such that its end 142 no longer contacts the gear 50. The indents 132 on the cam 130 are located on that cam in position such that when the gear sector 110 is rotating the gear 114, and thus oscillating the head 12, the end 142 is alternately contacted against and then lifted from the gear 50. Thus, the toy 10 emits its noise simultaneously with oscillation of the head 12. When the toy robot 10 is moving forward, the output member 134 is positioned by the cam 130 such that the end 142 does not contact the gear 50 and no noise is emitted.

It is evident from viewing the drawings, that the gear train between the motor 38 and the control element 102 includes the control gear formed of the spur gear 62 and worm gear 64. This control gear is always rotating, and, further, is capable of moving axially depending upon interaction of the cam 108 with the top of the worm gear 64. Thus, the control gear rotates the control element 102, but in turn, the control element 102 axially moves the control gear.

I claim:

1. A drive mechanism for a toy which comprises:

a housing;

a motor mounted on said housing, said motor for producing a rotational output;

a gear train mounted on said housing in operative association with said motor and driven by said motor;

said gear train including a control gear, said control gear being mounted on said housing so as to be both rotatably movable relative thereto and movable on said housing along the axis of its rotational movement, said control gear being rotated in said gear train in response to rotation of said motor;

a control means rotatably mounted on said housing in operative association with said gear train, said control means being rotated on said housing by said gear train, said control means operatively associated with said control gear to move said control gear axially from a first to a second position in response to each rotation of said control means on said housing;

a first output means movably mounted on said housing in direct association with said control gear, said first output means for producing a first intermittent output of said drive mechansim, said control gear engaging said first output means when said control gear is in its second position and when so engaged said control gear mechanically moving said first output means with respect to said housing, said control gear being disengaged from said first output means when said control gear is in its first position;

a second output means movably mounted on said housing in operative association with said control means, said second output means for producing an additional intermittent output;

said control means including second output means engagement means for intermittently engaging said second output means as said control means rotates on said housing, said second output means moving with respect to said housing when said second output means is engaged by said second output means engagement means and said second output means being stationary with respect to said housing when not engaged by said second output engagement means;

a third output means movably mounted on said housing in operative association with said control means, said third output means for producing a further intermittent output;

said control means including a third output means engagement means for intermittently engaging said third output means as said control means rotates on said housing, said third output means being movable from a first to a second position in response to being engaged and not being engaged by said third output means engagement means.

2. A drive mechanism for a toy which comprises:

a housing;

a motor means mounted on said housing, said motor means being for producing a rotational output;

a gear train means mounted on said housing in operative association with said motor means so as to be driven by said motor means, said gear train means including a control gear, said control gear being mounted on said housing so as to be both rotatably movable relative thereto and movable on said housing along the axis of its rotational movement, said control gear being rotated in said gear train means in response to rotation of said motor means;

a control means rotatably mounted on said housing in operative association with said gear train means, said control means being rotated on said housing by said gear train means, said control means being operatively associated with said control gear so as to move said control gear axially from a first to a second position in response to each rotation of said control means on said housing;

a first output means movably mounted on said housing in association with said control gear, said first output means being for producing a first intermittent output of said drive mechanism, said control gear engaging said first output means when said control gear is in its second position and when so engaged said control gear mechanicly moving said first output means with respect to said housing, said control gear being disengaged from said first output means when said control gear is in its first position;

said control means includes a control element rotatably mounted on said housing in association with said gear train means, said control element being rotated on said housing by said gear train means;

said control element including a first output engagement means located thereon, said first output engagement means being positioned on said control element in association with said control gear, said first output engagement means intermittently contacting said control gear to move said control gear from its first to its second position;

said control element includes a first set of gear teeth located thereon, said first set of gear teeth engaging with said gear train means, said gear train means rotating said first set of gear teeth so as to rotate said control element;

a second output means movably mounted on said housing in operative association with said control means, said second output means being for producing an additional intermittent output;

said control element including an additional set of gear teeth located thereon, said additional set of gear teeth being for intermittently engaging said second ooutput means as said control means rotates on said housing, said second output means moving with respect to said housing when said second output means is engaged by said additional set of gear teeth and said second output means stationary with respect to said housing when not engaged by said additional set of gear teeth.

3. The drive mechanism of claim 1 wherein:

said third output engagement means includes a circumferentially extending cam means located on said control means in a position so as to engage said third output means and to move said third output means on said housing.

4. The drive mechanism of claim 2 wherein:

said additional set of gear teeth are shaped as a gear sector;

said second output means including an input gear, said input gear positioned in association with said gear sector so as to be intermittently contacted by said gear sector as said control element rotates on said housing.

5. The drive mechanism of claim 4 wherein:

said first output engagement means includes a first cam means located on said control element in a position so as to intermittently engage said control gear moving said control gear between its first and second positions.

a third output means movably mounted on said housing in operative association with said control element, said third output means for producing a further intermittent output;

said control element including a further mens for intermittently engaging said further output means as said control element rotates on said housing, said further output means movable between first and second positions in response to being engaged and not being engaged by said further means.

6. The drive mechanism of claim 5 wherein:

said control element includes a first set of gear teeth located thereon, said first set of gear teeth engaging with said gear train means, said gear train mens rotating said first set of gear teeth so as to rotate said control element;

said control gear is interspaced in said gear train means between said motor means and said first set of gear teeth on said control element so that rotation of said motor means is transferred by said gear train means to said control element through said control gear.

7. The drive mechanism of claim 6 wherein:

said first output means includes a drive wheel means, said drive wheel means rotatably mounted on said housing in a position so as to contact a support surface, said drive wheel means rotated on said housing in response to rotation of said motor means transferred to said first output means, said rotation of said drive wheel means moving said housing over said support surface.

8. The drive mechanism of claim 7 including:

a member movably mounted on said housing, said second output means operatively associated with said member so as to move said member on said housing in response to rotation of said motor means transferred to said second output means.

* * * * *

UNITED STATES PATENT AND TRADEMARK OFFICE

CERTIFICATE OF CORRECTION

PATENT NO. : 4,752,272

DATED : JUNE 21, 1988

INVENTOR(S) : HIDEYASU KARASAWA

It is certified that error appears in the above-identified patent and that said Letters Patent is hereby corrected as shown below:

Column 1, line 62, "mountedon" should be --mounted on--.

Column 3, line 26, "woould" should be --would--.

Column 3, line 65, after the words "to a small" insert the line --electric motor 38. The switch member 36 has a small--.

Column 4, line 65, after the words "28 attached" insert the line --thereto, to the left as seen in Fig. 8. Since the yoke 82--.

Column 5, line 11, "see" should be --seen--.

Column 5, line 59, "positioed" should be --positioned--.

Column 6, line 20, "the" should be --The--.

Column 6, line 22, "the" should be --The--.

Column 6, line 32, "the" should be --The--.

UNITED STATES PATENT AND TRADEMARK OFFICE

CERTIFICATE OF CORRECTION

PATENT NO. : 4,752,272

DATED : JUNE 21, 1988

INVENTOR(S) : HIDEYASU KARASWAWA

It is certified that error appears in the above-identified patent and that said Letters Patent is hereby corrected as shown below:

Column 7, line 24, insert --drive-- between "the" and "mechanism".

Column 8, line 6, "mechansim" should be --mechanism--.

Column 8, line 66, "mechaniclly" should be --mechanically--.

Column 9, line 27, "ooutput" should be --output--.

Column 10, line 22, "mens" should be --means--.

Signed and Sealed this

Twenty-eighth Day of February, 1989

*Attest:*

DONALD J. QUIGG

*Attesting Officer*

*Commissioner of Patents and Trademarks*